US008044908B2

(12) United States Patent
Lee

(10) Patent No.: US 8,044,908 B2
(45) Date of Patent: Oct. 25, 2011

(54) LIQUID CRYSTAL DISPLAY DEVICE AND METHOD OF DRIVING THE SAME

(75) Inventor: Se-Hoon Lee, Asan-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 937 days.

(21) Appl. No.: 12/013,151

(22) Filed: Jan. 11, 2008

(65) Prior Publication Data

US 2008/0170064 A1 Jul. 17, 2008

(30) Foreign Application Priority Data

Jan. 12, 2007 (KR) ..... 10-2007-0003791

(51) Int. Cl.
*G09G 3/36* (2006.01)

(52) U.S. Cl. ..... 345/94

(58) Field of Classification Search ..... 345/87, 345/94, 98

See application file for complete search history.

(56) References Cited

U.S. PATENT DOCUMENTS

2001/0033266 A1* 10/2001 Lee ..... 345/94
2007/0035501 A1* 2/2007 Moh ..... 345/98

* cited by examiner

*Primary Examiner* — Chanh Nguyen
*Assistant Examiner* — Jonathan Blancha
(74) *Attorney, Agent, or Firm* — F. Chau & Associates, LLC

(57) ABSTRACT

A liquid crystal display device includes a timing controller generating a voltage compensation control pulse and a gate control signal, a voltage compensation signal generator generating a voltage compensation signal, the voltage level of which is gradually reduced during one frame period, in response to the voltage compensation control pulse, a power unit outputting a gate-on voltage to a plurality of gate lines by gradually increasing the level of the gate-on voltage in response to the voltage compensation signal, and a gate driver sequentially supplying the gate-on voltage to the plurality of gate lines in response to the gate control signal.

15 Claims, 6 Drawing Sheets

LIQUID CRYSTAL DISPLAY DEVICE AND METHOD OF DRIVING THE SAME

CROSS-REFERENCE TO RELATED APPLICATION

This application claims priority to, and the benefit of, Korean Patent Application No. 10-2007-0003791, filed on Jan. 12, 2007, the disclosure of which is herein incorporated by reference in its entirety.

BACKGROUND OF THE INVENTION

1. Technical Field

The present invention relates to a liquid crystal display (LCD) device and, more particularly, to an LCD device and a method of driving the same that can substantially prevent variations in brightness of an LCD panel by gradually increasing the level of a gate-on voltage.

2. Discussion of Related Art

A liquid crystal display (LCD) device displays an image by applying an electric field to a liquid crystal material having dielectric anisotropy injected between two substrates and by controlling the intensity of the electric field to control the amount of light transmitted through the liquid crystal material.

The LCD device may be classified into an active matrix type and a passive matrix type according to driving methods. An LCD device using a thin film transistor (TFT) of the active matrix type is widely used. The TFT may be formed of amorphous silicon or polysilicon. The TFT using polysilicon has low power consumption and low manufacturing costs; however, the manufacturing process is complicated. The TFT using amorphous silicon, having a less complicated manufacturing process, is widely used as an LCD element for a large screen LCD. Moreover, a gate driving circuit may be integrated into an LCD panel using the amorphous silicon TFTs. In this case, the gate driving circuit is provided on the LCD panel and thereby a separate driving integrated circuit is not required.

When such an amorphous silicon gate (ASG) is used, variations in brightness occur between the top and bottom of the panel as the panel size increases due to a gate-on voltage being lower towards the bottom of the panel. Therefore, voltages applied to pixels vary according to the position of the panel, even though the same data voltage is applied.

SUMMARY OF THE INVENTION

According to embodiments of the present invention a liquid crystal display (LCD) device and a method of driving the same that can substantially prevent variations in brightness between the top and bottom of an LCD panel by including a voltage compensation signal generator.

According to an exemplary embodiment of the present invention a liquid crystal display (LCD) device includes a timing controller generating a voltage compensation control pulse and a gate control signal; a voltage compensation signal generator generating a voltage compensation signal, of which voltage level is gradually changed during one frame period, in response to the voltage compensation control pulse; a power unit outputting a gate-on voltage to a plurality of gate lines by gradually changing the level of the gate-on voltage in response to the voltage compensation signal; and a gate driver having a plurality of stages, the gate driver sequentially supplying the gate-on voltage to the plurality of gate lines in response to the gate control signal.

The voltage compensation signal generator generates a voltage compensation signal, of which voltage level gradually decreases, the power unit outputs the gate-on voltage by gradually increasing the level of the gate-on voltage in response to the voltage compensation signal, and the gate driver sequentially supplies the gate-on voltage to the plurality of gate lines in response to the gate control signal from a first stage to a last stage.

The voltage compensation signal generator generates a voltage compensation signal, of which voltage level gradually increases, the power unit outputs the gate-on voltage by gradually decreasing the level of the gate-on voltage in response to the voltage compensation signal, and the gate driver sequentially supplies the gate-on voltage to the plurality of gate lines in response to the gate control signal from the last stage to the first stage.

The voltage compensation signal generator includes a charge/discharge unit charging the voltage compensation control pulse received from the timing controller and gradually discharging the voltage compensation control pulse during the one frame period, and a voltage dividing unit dividing a voltage by a current discharged through the charge/discharge unit and supplying the divided voltage as the voltage compensation signal.

The voltage dividing unit includes a plurality of resistors connected in one of series and parallel.

The charge/discharge unit includes a capacitor connected to the voltage dividing unit in parallel.

The power unit includes a gate-on signal generator generating a pulse signal, of which the pulse width of the pulse signal being modulated by a driving voltage provided to an input terminal thereof, in response to the voltage compensation control pulse, and switching a switch connected to an output terminal thereof according to the pulse signal, and an inductor connected to the input terminal and the output terminal and one of charging and discharging the driving voltage to output as the gate-on voltage.

The voltage compensation control pulse is turned on before the gate-on voltage is input to the gate driver and turned off when the gate-on voltage is input to the gate driver.

The voltage level of the voltage compensation signal is gradually increased by a charged voltage, when the voltage compensation control pulse is turned on, and gradually reduced by a discharged voltage, when the voltage compensation control pulse is turned off, during the one frame period.

The level of the gate-on voltage is gradually reduced in a section where the voltage level of the voltage compensation signal is gradually increased, and gradually increased during the one frame period where the voltage level of the voltage compensation signal is gradually reduced.

According to another exemplary embodiment of the present invention a method of driving an LCD device, includes generating, at a timing controller, a voltage compensation control pulse and a gate control signal, generating, at a voltage compensation signal generator, a voltage compensation signal, a voltage level of the voltage compensation signal being gradually reduced during one frame period, in response to the voltage compensation control pulse, outputting, at a power unit, a gate-on voltage to a plurality of gate lines by gradually increasing the level of the gate-on voltage in response to the voltage compensation signal, and sequentially supplying, at a gate driver, the gate-on voltage to the plurality of gate lines in response to the gate control signal.

In the process of generating the voltage compensation control pulse, the voltage compensation control pulse is generated before the gate-on voltage is input to the gate driver.

The process of generating the voltage compensation signal includes charging the voltage compensation control pulse received from the timing controller and gradually discharging the voltage compensation control pulse during the one frame period, and dividing an input voltage by the discharged current and providing the divided voltage as the voltage compensation signal.

In the process of generating the voltage compensation signal, the voltage level of the voltage compensation signal is gradually increased by receiving the voltage compensation control pulse, and gradually reduced during the one frame period.

In the process of outputting the gate-on voltage, the level of the gate-on voltage is gradually reduced in a section where the voltage level of the voltage compensation signal is gradually increased, and gradually increased during the one frame period where the voltage level of the voltage compensation signal is gradually reduced.

BRIEF DESCRIPTION OF THE DRAWINGS

The present invention will be described in reference to certain exemplary embodiments thereof with reference to the attached drawings in which.

DETAILED DESCRIPTION OF PREFERRED EMBODIMENTS

Figure 1:
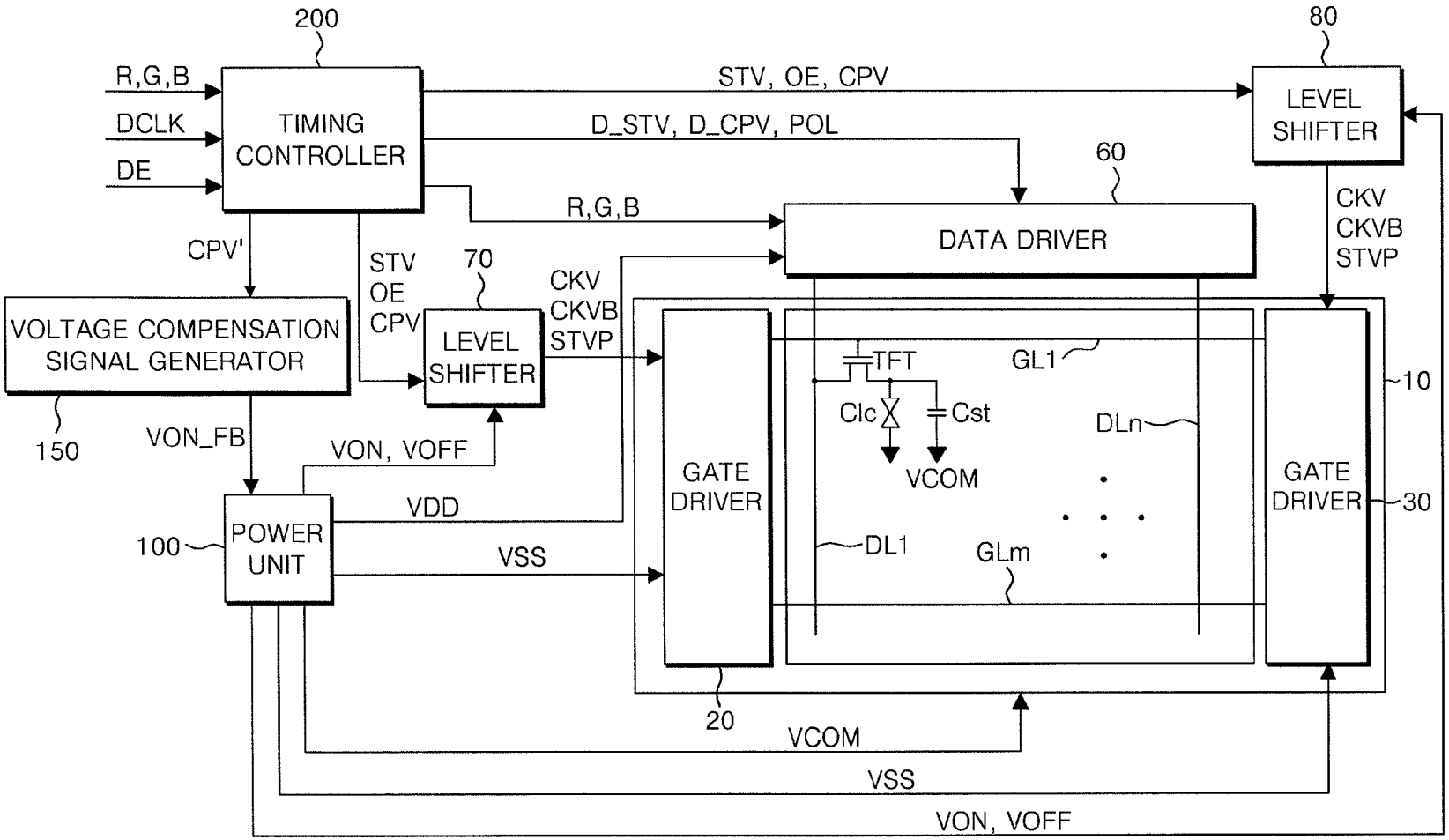
FIG. 1 is a block diagram schematically showing an LCD device in accordance with an exemplary embodiment of the present invention.

Reference will now be made in detail to embodiments of the present invention, examples of which are illustrated in the accompanying drawings, wherein like reference numerals refer to the like elements throughout. Exemplary embodiments are described below in order to explain the present invention by referring to the figures.

Figure 2:
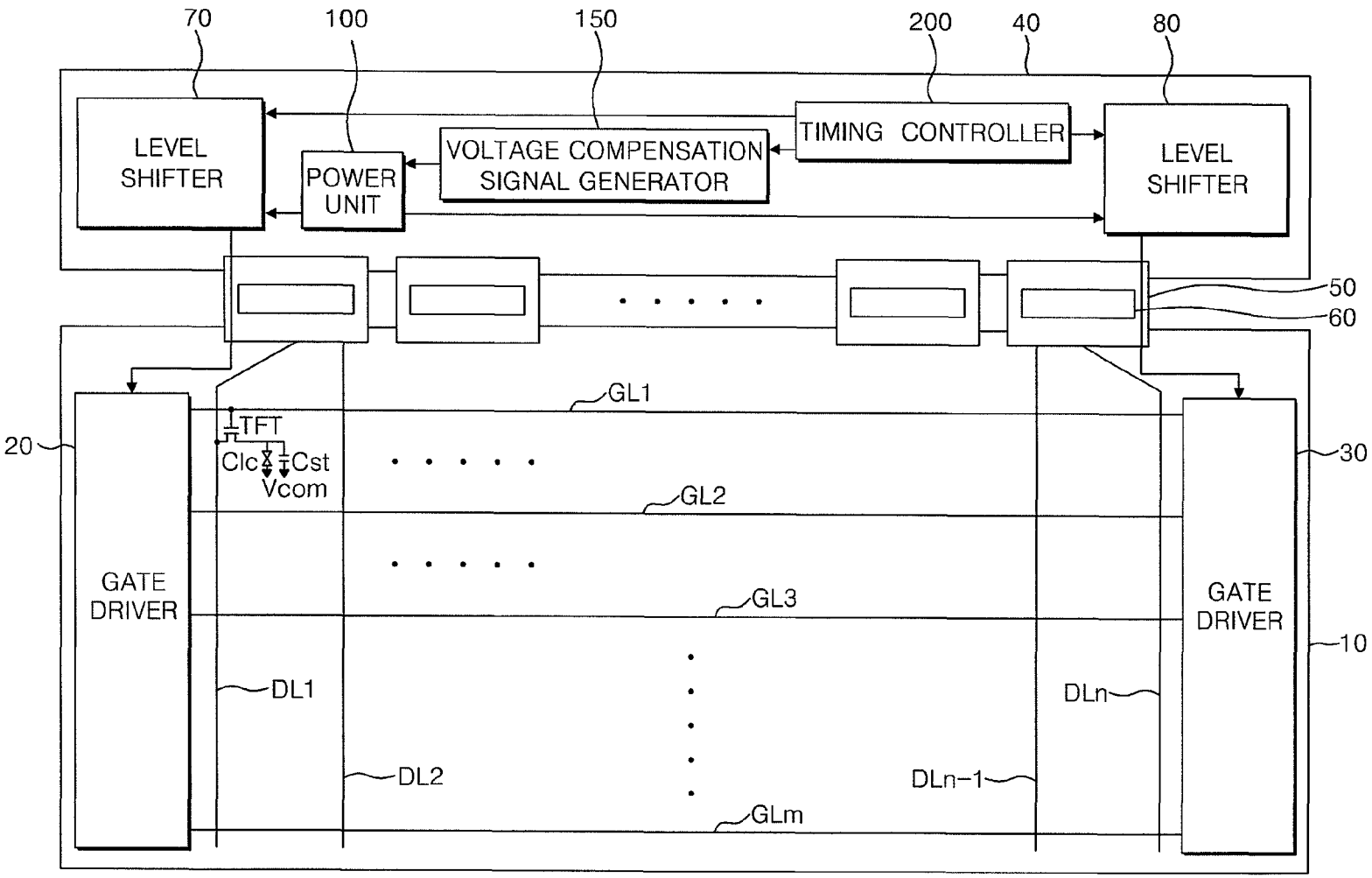
FIG. 2 is a block diagram showing in detail the configuration of the LCD device shown in FIG. 1.

FIG. 1 is a block diagram schematically showing an LCD device in accordance with an exemplary embodiment of the present invention, and FIG. 2 is a block diagram showing in detail the configuration of the LCD device shown in FIG. 1.

Referring to FIGS. 1 and 2, an LCD device in accordance with an exemplary embodiment includes a liquid crystal panel 10, gate drivers 20 and 30, level shifters 70 and 80, a timing controller 200, a voltage compensation signal generator 150, a power unit 100, and a data driver 60.

More specifically, the liquid crystal panel 10 includes a thin film transistor (TFT) substrate on which a TFT array is provided, a color filter substrate, on which a color filter array is formed, facing the TFT substrate, and a liquid crystal material disposed between the TFT substrate and the color filter substrate.

The color filter substrate includes a black matrix for substantially preventing light leakage, the color filter array for realizing colors, and a common electrode for applying a common voltage to the liquid crystal.

The liquid crystal material is controlled by a voltage difference between a pixel electrode supplied with a data signal and the common electrode supplied with the common voltage, which is a reference voltage. Accordingly, the liquid crystal material having dielectric anisotropy is rotated according to the voltage difference to change the light transmittance. As the liquid crystal material, a twisted nematic (TN) mode liquid crystal material or a patterned vertical alignment (PVA) mode liquid crystal material is used.

The TFT substrate includes a plurality of gate lines GL, a plurality of data lines DL, a pixel area formed at an intersection between the gate line GL and the data line DL, a TFT connected to the gate line GL and the data line DL at each pixel area, and a pixel electrode connected to the TFT. The gate drivers 20 and 30 for individually driving the plurality of gate lines GL1 to GLm are integrated into the TFT substrate. In this case, the gate drivers 20 and 30 are provided on both sides of the TFT substrate between which the plurality of gate lines GL1 to GLm is formed.

The timing controller 200 arranges image data signals, e.g., R, G and B signals, input from the outside and provides the arranged image data signals to the data driver 60. The timing controller 200 generates a plurality of control signals for controlling driving timings of the level shifters 70 and 80 and the data driver 60 using a plurality of synchronization signals, such as a dot clock signal DCLK, a data enable signal DE, a vertical synchronization signal VSYC, a horizontal synchronization signal HSYC, etc., input together with the image data signals from the outside, and supplies the control signals to the level shifters 70 and 80 and the data driver 60. For example, the timing controller 200 generates control signals including a gate start pulse STV, a gate shift clock CPV, an output control signal OE, etc., and supplies the same to the level shifters 70 and 80. Moreover, the time controller 200 generates data control signals including a data start pulse D_STV, a data shift clock D_CPV, a polarity control signal POL, etc., and supplies the same to the data driver 60.

The level shifters 70 and 80 generate a clock signal CKV, an inverse clock signal CKVB, and a gate start pulse STV, and supply the same to the gate drivers 20 and 30. For this, the level shifters 70 and 80 generate the clock signal CKV and the inverse clock signal CKVB using the gate shift clock CPV and the output control signal OE supplied from the timing controller 200. The generated clock signal CKV and the inverse clock signal CKVB are supplied to the gate drivers 20 and 30. Moreover, the level shifters 70 and 80 convert the gate start pulse STV supplied from the timing controller 200 into a start pulse STVP and provide the same to the gate drivers 20 and 30.

Furthermore, the timing controller 200 generates a voltage compensation control pulse CPV'. The voltage compensation control pulse CPV' generated from the timing controller 200 is input to the voltage compensation signal generator 150.

The voltage compensation signal generator 150 generates a voltage compensation signal VON_FB. A voltage level of the voltage compensation signal VON_FB is gradually reduced during one frame period, in response to the voltage compensation control pulse CPV' input from the timing controller 200.

The power unit 100 outputs a gate-on voltage VON to a plurality of gate lines GL by gradually increasing the level of the gate-on voltage VON in response to the voltage compensation signal VON_FB.

The power unit 100 generates an analog driving voltage AVDD, a common voltage VCOM, a gate-on voltage VON, and a gate-off voltage VOFF using an input driving voltage. The analog driving voltage AVDD is supplied to data driver 60, and the common voltage VCOM is supplied to the liquid crystal panel 10. The gate-on and gate-off voltages VON and VOFF are supplied to the level shifters 70 and 80. The level of the gate-on voltage VON supplied to the gate lines GL is gradually increased from the first gate line GL1 to the last gate line GLm.

The data driver 60 converts digital data into an analog data signal in response to the control signal from the timing controller 200 and supplies the analog data signal to the data line DL when the gate-on voltage VON is provided to the gate line GL of the liquid crystal panel. The data driver 60 includes a shift register, a latch unit, a digital-to-analog converter, and an output buffer. The shift register sequentially shifts the data start pulse D_STV from the timing controller 200 according to the data shift clock D_CPV and, at the same time, generates a sampling signal. The latch unit sequentially latches the data input from the timing controller 200 in response to the sampling signal and, when the data corresponding to one horizontal line is all latched, supplies the data input from the timing controller 200 to the digital-to-analog converter at the same time. The digital-to-analog converter selects a gamma voltage, corresponding to the data from the latch unit, from a plurality of gamma voltages and outputs the selected gamma voltage as an analog data signal. The output buffer buffers the data signal from the digital-to-analog converter and supplies the data signal to the data line DL. The digital-to-analog converter selects a positive or negative polarity gamma voltage according to the polarity control signal POL from the timing controller 200 and outputs the selected gamma voltage as the analog data signal. The digital-analog converter outputs data signals having polarities opposite to each other to adjacent output channels in response to the polarity control signal POL corresponding to a vertical dot inversion method so that the polarities of the data signals supplied through the output channels may be inverted in a horizontal period unit.

As shown in FIG. 2, the data driver 60 is mounted in a data tape carrier package (TCP) 50 connected to a data printed circuit board (PCB) 40. The data PCB 40 mounts the timing controller 200 and the power unit 100. The image signal, the control signal and the power signal generated from the timing controller 200 and the power unit 100 mounted in the data PCB 40 are supplied to the liquid crystal panel 10 by way of signal lines formed in the data TCP 50.

Figure 3:
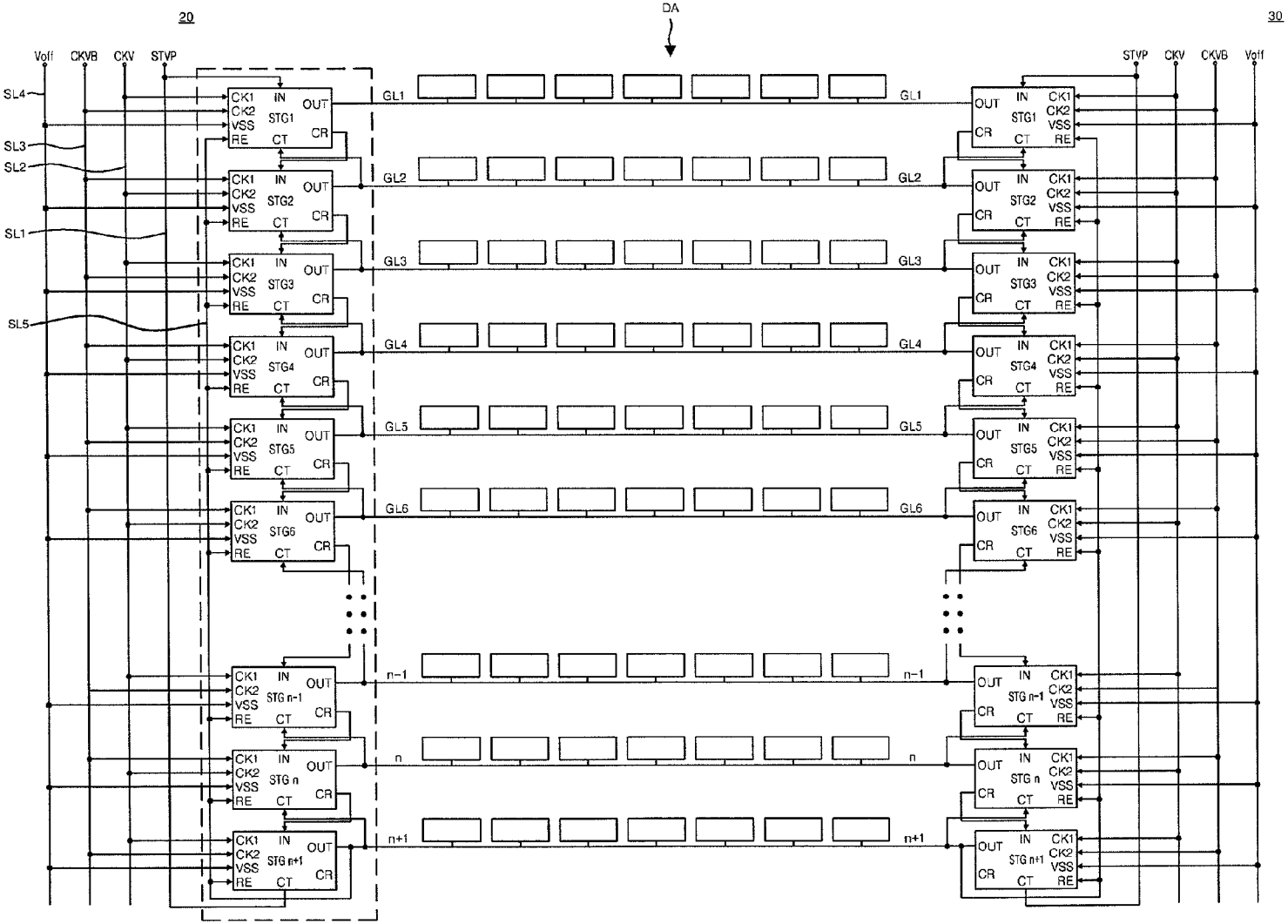
FIG. 3 is a block diagram schematically showing the configuration of a gate driver shown in FIGS. 1 and 2.

FIG. 3 is a block diagram of the first and second gate driving circuits shown in FIGS. 1 and 2.

As shown in FIG. 3, the first and second gate drivers 20 and 30 have a structure symmetric to each other with respect to the gate lines GL1, . . . , GLn. The first and second gate drivers 20 and 30 receive various signals from the data driver 60 and transmit the received signals to the shift registers through signal lines to sequentially output the gate driving signal. The shift register includes a plurality of stages STG1, . . . , STGn+1, which are cascaded to each other. Each of the first to the (n+1)th stages STG1, . . . , STG(n+1) connected to one another is electrically connected to sequentially output the gate driving signal. The (n+1)th stage STG(n+1) indicates a dummy stage. Herein, n is an even number.

Each of the stages STG1, . . . , STG(n+1) includes first and second clock terminals CK1 and CK2, an input terminal IN, a control terminal CT, an output terminal OUT, a reset terminal RE, a carry terminal CR, and a ground voltage terminal VSS.

In odd-numbered stages STG1, STG3, . . . , STG(n+1) among the stages STG1, . . . , STG(n+1), the first clock terminal CK1 receives a gate clock pulse CKV and the second clock terminal CK2 receives a gate clock bar pulse CKVB. In even-numbered stages STG2, STG4, . . . , STGn among the stages STG1, . . . , STG(n+1), the first clock terminal CK1 receives a gate clock bar pulse CKVB and the second clock terminal CK2 receives a gate clock pulse CKV.

The input terminal IN of each of the stages STG1, . . . , STG(n+1) is connected to the carry terminal CR of a previous stage to receive a carry signal of the previous stage, and the control terminal CT is connected to the output terminal OUT of a next stage to receive the output signal of the next stage. The input terminal IN of the first stage STG1 receives a start pulse STVP because there exist no a previous stage. The carry signal outputted from the carry terminal CR drives the next stage.

It is preferable that the control terminal CT of the dummy stage STG(n+1) supplying the control terminal CT of the nth stage STGn with a carry signal receives a start pulse STVP. The ground voltage terminal VSS of the stages STG1, . . . , STG(n+1) receives the ground voltage VOFF and the reset terminal RE receives the output signal of (n+1)th stage STG (n+1).

Further, the output terminals OUT of the odd-numbered stages STG1, STG3, . . . , STG(n+1) among the stages STG1, . . . , STG(n+1) output the gate clock pulse CKV as a gate driving signal and the carry terminals CR thereof output the gate clock pulse CKV as a carry signal. The output terminals OUT of the even-numbered stages STG2, STG4, STGn among the stages STG1, . . . , STG(n+1) output the gate clock bar pulse CKVB as a gate driving signal and the carry terminals CR thereof output the gate clock bar pulse CKVB as a carry signal. In other words, the first gate driver 20 outputs the gate driving signals by synchronizing the gate clock pulse CKV with the odd-numbered stages STG1, STG3, . . . , STG(n+1), and synchronizing the gate clock bar pulse CKVB with the even-numbered stages STG2, STG4, . . . , STGn.

The output terminals OUT of the stages STG1, . . . , STGn of the first gate driver 20 are connected to the gate lines GL1, . . . , GLn, respectively to sequentially supply the gate driving signal to the gate lines GL1, . . . , GLn to sequentially drive the gate lines GL1, . . . , GLn.

The signal line includes a start pulse wiring SL1, a gate clock pulse wiring SL2, a gate clock bar pulse wiring SL3, a ground voltage wiring SL4, and a reset wiring SL5, which are extended parallel to one another.

The start pulse wiring SL1 receives the start pulse STVP from the first level shifter 70 and delivers the start pulse STVP to the input terminal of the first stage STG1 and the control terminal CT of the (n+1)th stage STG(n+1).

The gate clock pulse wiring SL2 receives the gate clock pulse CKV from the first level shifter 70 and delivers the gate clock pulse CKV to the first clock terminals CK1 of the odd-numbered stages STG1, STG3, . . . , STG(n+1) and the second clock terminals CK2 of the even-numbered stages STG2, STG4, . . . , STGn.

The gate clock bar pulse wiring SL3 receives the gate clock bar pulse CKVB from the first level shifter 70 and delivers the gate clock bar pulse CKV to the second clock terminals CK2 of the odd-numbered stages STG1, STG3, . . . , STG(n+1) and the first clock terminals CK1 of the even-numbered stages STG2, STG4, . . . , STGn.

The ground voltage wiring SL4 receives the gate-off voltage VOFF from the power supply 100 and delivers the gateoff voltage VOFF to the ground voltage terminal VSS of the first to (n+1)th stages STG1, . . . , STG(n+1).

The reset wiring SL5 supplies the reset terminal RE of the stages STG1, STG(n+1) with the output signal of the output terminal OUT of the (n+1)th stage STG(n+1) as a reset signal REsig.

The second gate driver 30 is symmetric to the first gate driver 20 with respect to the gate lines GL1, . . . , GLn. Accordingly, the second gate driver 30 has the same configuration as that of the first gate driver 20, and therefore the detailed description of the second gate driver 30 will be omitted.

The gate drivers 20 and 30 are not limited to the first and second gate driver 20 and 30 in accordance with the exemplary embodiment of the present invention, but may be formed with one gate driver. The second gate driver has the same configuration as that of the first gate driver 20, and therefore the detailed description of the second gate driver 30 is not required.

Further, the gate drivers 20 and 30 may be formed such that the odd-numbered stages STG1, STG3, . . . , STG(n+1) of the first gate driver 20 are formed at one end of the gate lines GL1, . . . , GLn and the even-numbered stages STG2, STG4, . . . , STGn of the second gate driver 30 are formed at the other end of the gate lines GL1, . . . , GLn. Then the odd-numbered stages STG1, STG3, . . . , STG(n+1) and the even-numbered stages STG2, STG4, . . . , STGn may be alternately driven. The second gate driver 30 receives the gate clock pulse CKV outputted from the output terminal OUT of the first stage STG1 of the first gate driver 20 through the input terminal IN of the second stage STG2 and the control terminal CT of the nth stage STGn instead of receiving the start pulse STVP at the first stage of the even-numbered stages STG2, STG4, . . . , STGn. An operation of each of the odd-numbered stages STG1, STG3, . . . , STG(n+1) and the even-numbered stages STG2, STG4, . . . , STGn of the gate drivers 20 and 30 is the same as that of the first gate driver 20, and therefore the detailed description thereof will be omitted.

The gate clock pulse CKV may be inputted to the input terminal of the last stage STGn+1 as well as to the input terminal IN of the first stage STG1.

Figure 4:
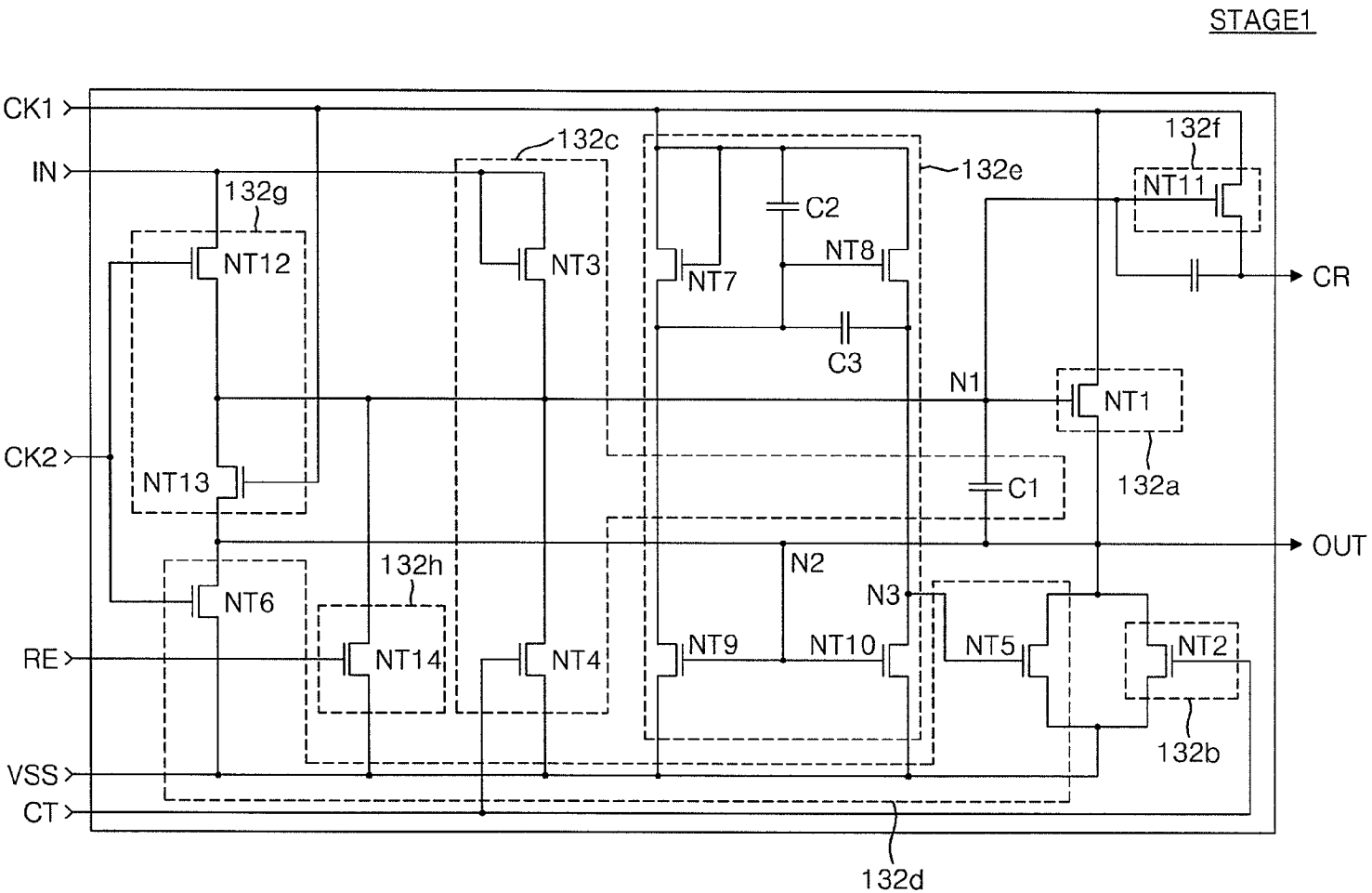
FIG. 4 is a detailed circuit diagram showing a first shift register shown in FIG. 3.

FIG. 4 is a circuit diagram for explaining the first stage shown in FIG. 3.

Herein, the first stage has the same configuration as each of the second to the (n+1)th stages, and therefore only configuration of the first stage will be described except for that of the second to the (n+1)th stages.

As shown in FIG. 4, the first stage includes a pull-up portion 132*a*, a pull-down portion 132*b*, a driving portion 132*c*, a holding portion 132*d*, a switching portion 132*e*, and a carry portion 132*f*.

The pull-up portion 132*a* pulls up the gate clock pulse CKV supplied through the first clock terminal CK1 to be output as the gate driving signal through the output terminal OUT. The pull-up portion 132*a* includes a first transistor NT1 with a gate electrode connected to a first node N1, a source electrode connected to the first clock terminal CK1, and a drain electrode connected to the output terminal OUT. The first transistor NT1 represents a pull-up transistor pulling up the gate clock pulse CKV. And the first transistor NT1 supplies the gate line of the pixel area with the gate driving signal through the output terminal OUT.

The pull-down portion 132*b* pulls down the gate driving signal pulled up in response to the carry signal from the second stage to the gate-off voltage VOFF supplied through the ground voltage terminal VSS. The pull-down portion 132*b* includes a second transistor NT2 with a gate electrode connected to a control terminal CT, a drain electrode connected to the output terminal OUT, and a source electrode connected to the ground voltage terminal VSS.

The driving portion 132*c* turns on the pull-up portion 132*a* in response to the start pulse STVP supplied through the input terminal IN and turns off in response to the carry signal of the second stage. For doing so, the driving portion 132*c* includes a buffer portion, a charging portion, and a discharging portion.

The buffer portion includes a third transistor NT3 with a gate electrode and a source electrode connected commonly to the input terminal IN and a source electrode connected to a first node N1. The charging portion includes a first capacitor C1 with a first electrode connected to the first node N1 and a second electrode connected to a second node N2. The discharging portion includes a fourth transistor NT4 with a gate electrode connected to the control terminal CT, a source electrode connected to the first node N1, and a drain electrode connected to the ground voltage terminal VSS.

When the input terminal IN receives the start pulse STVP, the third transistor NT3 is turned on responsive thereto, and the start pulse STVP is charged in the first capacitor C1. When a voltage higher than a threshold voltage of the first transistor NT1 is charged in the first capacitor C1, the first transistor NT1 is turned on to supply the gate clock pulse CKV supplied to the first clock terminal CK1 to the output terminal OUT. At this time, the potential of the first node N1 is bootstrapped by a variation of the potential of the second node N2 by a coupling of the first capacitor C1 in response to a variation of the potential of the second node N2. Therefore, the first transistor NT1 allows the first gate clock pulse CKV applied to the source electrode to be output through the output terminal OUT. Herein, the start pulse STVP uses the first transistor NT1 as a preparatory charging signal so as to generate the first gate driving signal. When the fourth transistor NT4 is turned on in response to the carry signal of the second stage inputted through the control terminal CT, the charges in the first capacitor C1 are discharged to the level of the gate-off voltage VOFF supplied through the ground voltage terminal VSS. The gate clock pulse CKV supplied to the output terminal OUT becomes the gate driving signal supplied to the gate line.

The holding portion 132*d* includes fifth and sixth transistors NT5 and NT6 holding the gate driving signal to the level of the gate-off voltage VOFF. The fifth transistor NT5 has a gate electrode connected to a third node N3, a source electrode connected to the second node N2, and a drain electrode connected to the ground voltage terminal VSS. The sixth transistor NT6 has a gate electrode connected to the second clock terminal CK2, a source electrode connected to the second node N2, and a drain electrode connected to the ground voltage terminal VSS.

The switching portion 132*e* includes seventh, eighth, ninth, and tenth transistors NT7, NT8, NT9, and NT10 and second and third capacitors C2 and C3, and controls driving of the holding portion 132*d*. The seventh transistor NT7 has gate and drain electrodes connected to the first clock terminal CK1 and a source electrode connected to the third node N3 through the third capacitor C3. The eighth transistor NT8 has a source electrode connected to the first clock terminal CK1, a gate electrode connected to the source electrode through the second capacitor C2, and a drain electrode connected to the third node N3 and the gate electrode through the third capacitor C3. The ninth transistor NT9 has a drain electrode connected to the source electrode of the seventh transistor NT7, a gate electrode connected to the second node N2, and a source electrode connected to the ground voltage terminal VSS. The tenth transistor NT10 has a source electrode connected to the third node N3, a gate electrode connected to the second node N2, and a drain electrode connected to the ground voltage terminal VSS.

When a high level of the gate clock pulse CKV is output as the gate driving signal to the output terminal OUT, the electric potential of the second node N2 becomes a high level. When the potential of the second node N2 becomes a high level, the ninth and tenth transistors NT9 and NT10 are switched to a turn-on state. At this time, although the seventh and eighth transistors NT7 and NT8 are switched to a turn-on state by the gate clock pulse CKV supplied to the first clock terminal CK1, the signal output from the seventh and eighth transistors NT7 and NT8 are discharged to the ground voltage VOFF through the ninth and tenth transistors NT9 and NT10. Accordingly, while a high level of the gate driving signal is output, the potential of the third node N3 maintains a low level and thus the fifth transistor NT5 maintains a turn-off state. The gate driving signal is discharged through the ground voltage terminal VSS in response to the carry signal of the second stage inputted through the control terminal CT, and the potential of the second node N2 gradually goes down to a low level. Accordingly, the ninth and tenth transistors NT9 and NT10 are switched to a turn-off state, and the potential of the third node N3 goes up to a high level by the signal outputted from the seventh and eighth transistors NT7 and NT8. As the potential of the third node N3 increases, the fifth transistor NT5 is turned on and the potential of the second node N2 is discharged to a ground voltage VOFF through the fifth transistor NT5.

In this state, when the sixth transistor NT6 is turned on by the gate clock bar pulse CKVB supplied to the second clock terminal CK2, the potential of the second node N2 is discharged through the ground voltage terminal VSS.

The fifth and sixth transistors NT5 and NT6 of the holding portion 132*d* hold the potential of the second node N2 to the ground voltage VOFF. The fifth transistor NT5 represents a holding transistor.

The switching portion 132*e* determines the timing when the fifth transistor NT5 is turned on. The fifth transistor NT5 of the switch portion 132*e* represents a switching transistor.

The carry portion 132*f* includes an eleventh transistor NT11 with a drain electrode connected to the first clock terminal CK1, a gate electrode connected to the first node N1, and a source electrode connected to the carry terminal CR. The eleventh transistor NT11 is turned on and supplies the gate clock pulse CKV inputted to the drain electrode to the carry terminal CR.

The first stage further includes a ripple preventing portion 132*g* and a reset portion 132*h*. The ripple preventing portion 132*g* prevents the gate driving signal maintained at the ground voltage VOFF from being rippled by a noise inputted through the input terminal IN. The ripple preventing portion 132*g* includes a twelfth transistor NT12 and a thirteenth transistor NT13. The twelfth transistor NT12 has a source electrode connected to the input terminal IN, a gate electrode connected to the second clock terminal CK2, and a drain electrode connected to the first node N1. The thirteen transistor NT13 has a drain electrode connected to the first node N1, a gate electrode connected to the first clock terminal CK1, and a source electrode connected to the second electrode N2.

The reset portion 132*h* includes a fourteenth transistor NT14 with a source electrode connected to the pull-up portion 132*a* through the first node N1, a gate electrode connected to the reset terminal RE, and a drain electrode connected to the ground voltage terminal VSS. The fourteenth transistor NT14 discharges a noise inputted through the input terminal IN in response to the reset signal which is an output signal of the (n+1)th stage inputted through the reset terminal RE. The reset portion 132*h* resets the first node N1 of each of the stages STG1, . . . , STGn to the ground voltage VOFF by turning on the fourteenth transistor NT14 of each of the stages STG1, . . . , STGn. Then, the stages STG1, . . . , STG(n+1) of the circuit portion 132 can operate at an initial state again.

Figure 5:
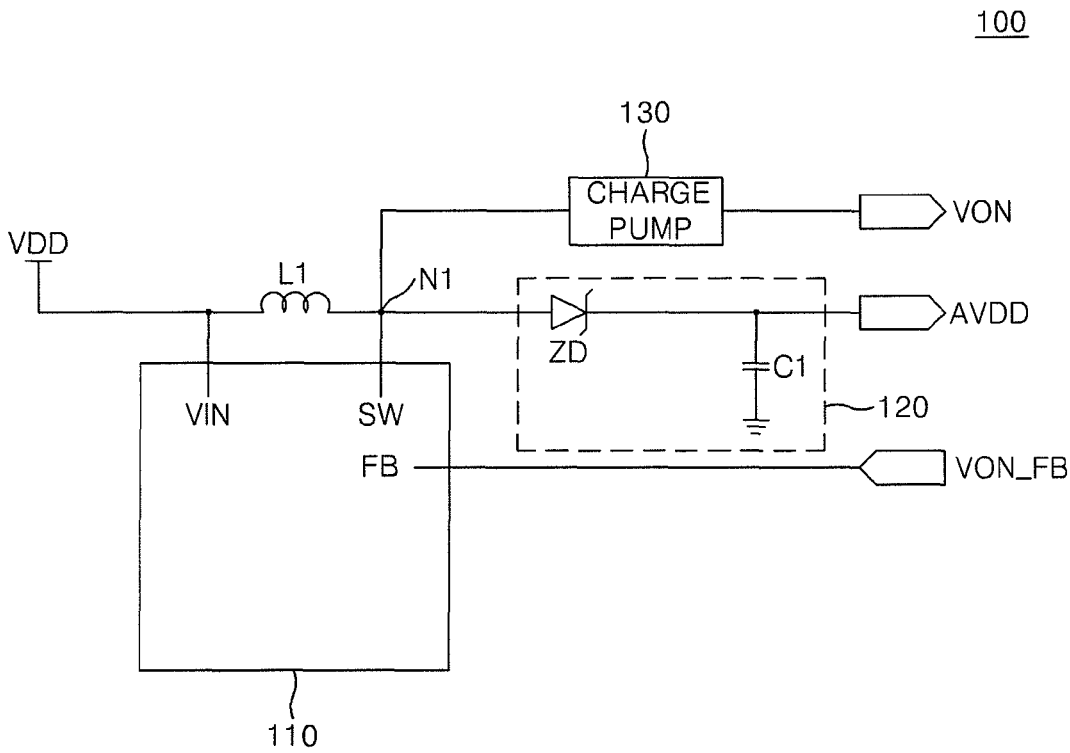
FIG. 5 is a circuit diagram showing the configuration of a power unit shown in FIGS. 1 and 2.
Figure 6:
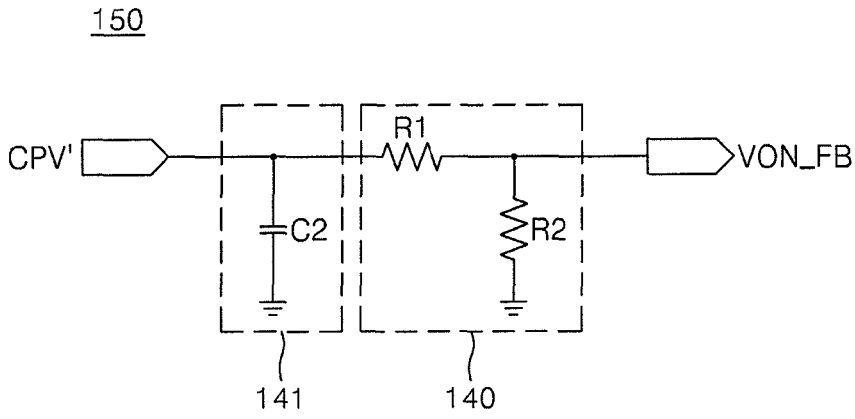
FIG. 6 is a circuit diagram showing the configuration of a voltage compensation signal generator shown in FIGS. 1 and 2.

FIG. 5 is a circuit diagram showing an exemplary configuration of the power unit 100 shown in FIGS. 1 and 2. FIG. 6 is a circuit diagram showing an exemplary configuration of the voltage compensation signal generator 150 shown in FIGS. 1 and 2.

Referring to FIG. 5, the power unit 100 includes a pulse width modulation circuit 110 having a feedback terminal FB, a rectifying circuit 120, and a charge pump 130.

The power unit 100 controls the pulse width modulation circuit 110 in response to a voltage compensation signal VON_FB input to the feedback terminal FB. The rectifying circuit 120 rectifies an amplified pulse signal generated in a first node N1 by the pulse width modulation circuit 110 and a reactance L1 and supplies the rectified signal as an analog driving voltage AVDD. The charge pump 130 generates a gate-on voltage VON by using the amplified pulse signal generated in the first node N1. Although the description has been made with reference to the generation of the gate-on voltage VON in an exemplary embodiment of the present invention, the generation process of the gate-off voltage VOFF is the same as the above.

The rectifying circuit 120 includes a Zener diode ZD connected to an output terminal SW of the pulse width modulation circuit 110, and a capacitor C1 connected between the Zener diode ZD and the ground and stabilizing the voltage output from the Zener diode ZD.

Referring to FIG. 6, the voltage compensation signal generator 150 includes a charge/discharge unit 141 and a voltage dividing unit 140. The charge/discharge unit 141 charges the voltage compensation control pulse CPV' received from the timing controller 200 and gradually discharges the voltage compensation control pulse CPV' during one frame period. The voltage dividing unit 140 divides the voltage by the current discharged through the charge/discharge unit 141 and supplies the divided voltage as the voltage compensation signal VON_FB.

The voltage compensation control pulse CPV' is charged by the charge/discharge unit 141 including a capacitor C2 and gradually discharged during one frame period. The voltage discharged by the charge/discharge unit 141 is divided by the voltage dividing unit 140 including first and second resistors R1 and R2 connected in parallel and generated as the voltage compensation signal VON_FB. Although the description has been made with reference to the voltage dividing unit 140 including the first and second resistors R1 and R2 and the charge/discharge unit 141 including the capacitor C2, it is possible to use a plurality of resistors R and capacitors C.

The voltage compensation signal generator 150 generates the voltage compensation signal VON_FB. The voltage level of the voltage compensation signal VON_FB is gradually reduced during one frame period, in response to the voltage compensation control pulse CPV' received from the timing controller 200. The voltage compensation control pulse CPV' is turned on before the gate driving voltage VON is input to the gate drivers 20 and 30 and turned off when the gate driving voltage VON is input to the gate drivers 20 and 30. Accordingly, the voltage compensation signal VON_FB is generated. A level of the voltage compensation signal VON_FB is gradually increased as much as the level of the turn-on voltage until the gate driving voltage VON is input to the gate drivers 20 and 30, and gradually reduced during one frame period, when the gate driving voltage VON is input to the gate drivers 20 and 30.

The power unit 100 gradually increases the level of the gate-on voltage VON and outputs the gate-on voltage VON to the plurality of gate lines GL. Accordingly, the level of the gate-on voltage VON is gradually reduced in a section where the voltage level of the voltage compensation signal VON_FB is gradually increased, and gradually increased during one frame period where the voltage level of the voltage compensation signal VON_FB is gradually reduced. The voltage compensation signal VON_FB is input to the feedback terminal FB. When the voltage compensation signal VON_FB is gradually reduced and input to the feedback terminal FB, the level of the gate-on voltage VON is not constant but gradually increased and output.

As described above, the LCD device in accordance with an embodiment of the present invention applies the voltage compensation signal VON_FB to the feedback terminal FB of the pulse width modulation circuit 110 of the power unit 100 to gradually increase the level of the gate-on voltage VON from the first to last lines of one frame, not applying the gate-on voltage VON with a constant level. Accordingly, the LCD device in accordance with an embodiment of the present invention can substantially prevent variations in brightness by gradually increasing the level of the driving voltage VON applied from the top to the bottom of the liquid crystal panel 10.

Figure 7:
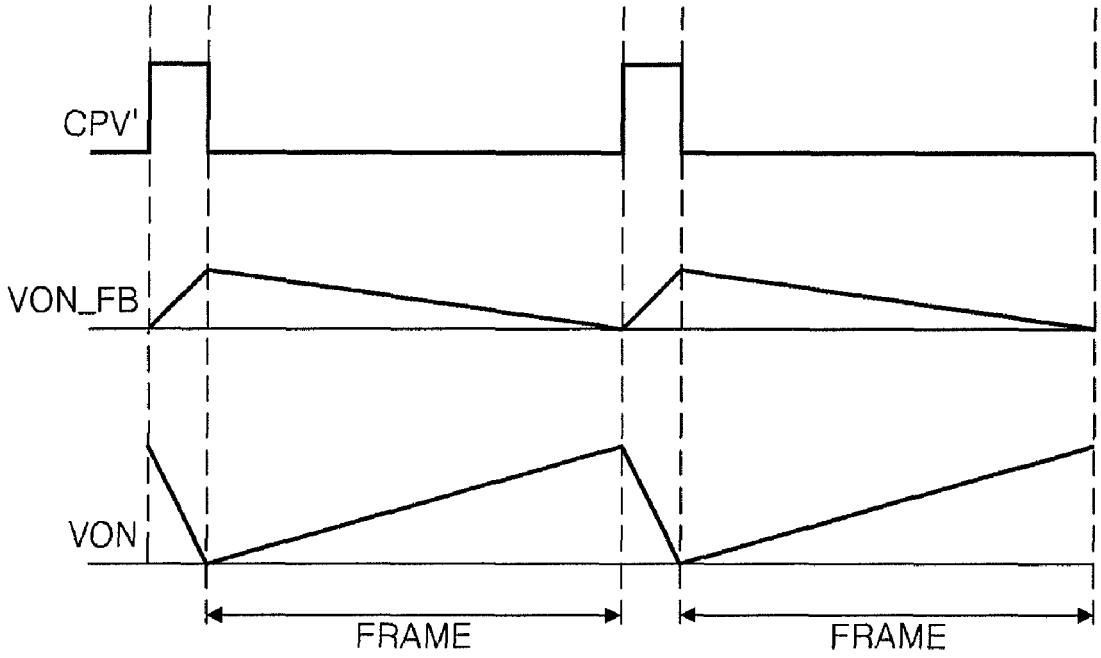
FIG. 7 is a waveform diagram showing a voltage compensation control pulse, a voltage compensation signal, and a gate-on voltage in accordance with an exemplary embodiment of the present invention.

FIG. 7 is a waveform diagram showing the voltage compensation control pulse, the voltage compensation signal, and the gate-on voltage in accordance with an exemplary embodiment of the present invention.

Referring to FIG. 7, the voltage compensation control pulse CPV' is turned on before the gate driving voltage VON is input to the gate drivers 20 and 30 and turned off when the gate-on voltage VON is input to the gate drivers 20 and 30.

Accordingly, when the voltage compensation control pulse CPV' is turned on, the level of the voltage compensation signal VON_FB is gradually increased as much as the turn-on voltage level and, when the voltage compensation control pulse CPV' is turned off, the voltage level of the voltage compensation signal VON_FB is gradually reduced. That is, the voltage compensation signal VON_FB has a voltage level gradually reduced during one frame period.

Accordingly, the gate-on voltage VON applied to the gate lines GL has a voltage level gradually reduced in a section where the voltage compensation signal VON_FB is increased and gradually increased during one frame period where the level of the voltage compensation signal VON_FB is reduced.

As described above, variations in brightness generated are substantially prevented between the top and bottom of the LCD panel by gradually increasing the level of the gate-on voltage.

That is, the LCD device and the method of driving the same in accordance with exemplary embodiments the present invention generate the voltage compensation signal VON_FB in response to the voltage compensation control pulse CPV' and output the gate-on voltage VON. A level of the gate-on voltage VON is gradually increased using the voltage compensation signal VON_FB, thus substantially preventing variations in brightness.

Although the present invention has been described with reference to certain exemplary embodiments thereof, it will be understood by those skilled in the art that a variety of modifications and variations may be made to the present invention without departing from the spirit or scope of the disclosure and equivalents thereof.

What is claimed is:

1. A liquid crystal display (LCD) device comprising:

a timing controller generating a voltage compensation control pulse and a gate control signal;

a voltage compensation signal generator generating a voltage compensation signal, of which voltage level is gradually changed during one frame period, in response to the voltage compensation control pulse;

a power unit outputting a gate-on voltage to a plurality of gate lines by gradually changing the level of the gate-on voltage in response to the voltage compensation signal; and a gate driver having a plurality of stages, the gate driver sequentially supplying the gate-on voltage to the plurality of gate lines in response to the gate control signal.

2. The LCD device of claim 1, wherein the voltage compensation signal generator generates a voltage compensation signal, of which voltage level gradually decreases, the power unit outputs the gate-on voltage by gradually increasing the level of the gate-on voltage in response to the voltage compensation signal, and the gate driver sequentially supplies the gate-on voltage to the plurality of gate lines in response to the gate control signal from a first stage to a last stage.

3. The LCD device of claim 1, wherein the voltage compensation signal generator generates a voltage compensation signal, of which voltage level gradually increases, the power unit outputs the gate-on voltage by gradually decreasing the level of the gate-on voltage in response to the voltage compensation signal, and the gate driver sequentially supplies the gate-on voltage to the plurality of gate lines in response to the gate control signal from the last stage to the first stage.

4. The LCD device of claim 1, wherein the voltage compensation signal generator comprises:

a charge/discharge unit charging the voltage compensation control pulse received from the timing controller and gradually discharging the voltage compensation control pulse during the one frame period; and a voltage dividing unit dividing a voltage by a current discharged through the charge/discharge unit and supplying the divided voltage as the voltage compensation signal.

5. The LCD device of claim 4, wherein the voltage dividing unit comprises a plurality of resistors connected in one of series and parallel.

6. The LCD device of claim 5, wherein the charge/discharge unit comprises a capacitor connected to the voltage dividing unit in parallel.

7. The LCD device of claim 1, wherein the power unit comprises:

a gate-on signal generator generating a pulse signal, a pulse width of the pulse signal being modulated by a driving voltage provided to an input terminal thereof, in response to the voltage compensation control pulse, and switching a switch connected to an output terminal thereof according to the pulse signal; and an inductor connected to the input terminal and the output terminal and one of charging and discharging the driving voltage to output as the gate-on voltage.

8. The LCD device of claim 6, wherein the voltage compensation control pulse is turned on before the gate-on voltage is input to the gate driver and turned off when the gate-on voltage is input to the gate driver.

9. The LCD device of claim 8, wherein the voltage level of the voltage compensation signal is gradually increased by a charged voltage, when the voltage compensation control pulse is turned on, and gradually reduced by a discharged voltage, when the voltage compensation control pulse is turned off, during the one frame period.

10. The LCD device of claim 9, wherein the level of the gate-on voltage is gradually reduced in a section where the voltage level of the voltage compensation signal is gradually increased, and gradually increased during the one frame period where the voltage level of the voltage compensation signal is gradually reduced.

11. A method of driving an LCD device, comprising:

generating, at a timing controller, a voltage compensation control pulse and a gate control signal;

generating, at a voltage compensation signal generator, a voltage compensation signal, a voltage level of the voltage compensation signal being gradually reduced during one frame period, in response to the voltage compensation control pulse;

outputting, at a power unit, a gate-on voltage to a plurality of gate lines by gradually increasing the level of the gate-on voltage in response to the voltage compensation signal; and supplying, sequentially, at a gate driver, the gate-on voltage to the plurality of gate lines in response to the gate control signal.

12. The method of claim 11, wherein generating the voltage compensation control pulse generates the voltage compensation control pulse before the gate-on voltage is input to the gate driver.

13. The method of claim 12, wherein generating the voltage compensation signal comprises:

charging the voltage compensation control pulse received from the timing controller and gradually discharging the voltage compensation control pulse during the one frame period; and dividing an input voltage by the discharged current and providing the divided voltage as the voltage compensation signal.

14. The method of claim 13, wherein generating the voltage compensation signal gradually increases the voltage level of the voltage compensation signal by receiving the voltage compensation control pulse, and gradually reduces the voltage level during the one frame period.

15. The method of claim 14, wherein outputting the gate-on voltage gradually reduces the level of the gate-on voltage in a section where the voltage level of the voltage compensation signal is gradually increased, and gradually increases the level of the gate-on voltage during the one frame period where the voltage level of the voltage compensation signal is gradually reduced.

* * * * *